US008336746B2

(12) United States Patent
Leach

(10) Patent No.: US 8,336,746 B2
(45) Date of Patent: Dec. 25, 2012

(54) ARCHERY BOW CARRYING APPARATUS

(76) Inventor: Boyd E. Leach, Indianapolis, IN (US)

( * ) Notice: Subject to any disclaimer, the term of this patent is extended or adjusted under 35 U.S.C. 154(b) by 161 days.

(21) Appl. No.: 12/779,615

(22) Filed: May 13, 2010

(65) Prior Publication Data

US 2011/0278333 A1 Nov. 17, 2011

(51) Int. Cl.
*A45F 3/14* (2006.01)
*A45F 5/00* (2006.01)

(52) U.S. Cl. ..... 224/257; 224/916; 224/268

(58) Field of Classification Search ..... 224/258, 224/257, 259, 260, 913, 916, 268, 269; 124/91; 206/315.11, 317
See application file for complete search history.

(56) References Cited

U.S. PATENT DOCUMENTS 3,886,924 A * 6/1975 Chesnick ..... 124/23.1
4,684,047 A 8/1987 Burgwin
5,038,987 A * 8/1991 Huddleston ..... 224/258
5,239,976 A * 8/1993 Specht ..... 124/88
5,246,154 A * 9/1993 Adams et al. ..... 224/257
5,425,485 A * 6/1995 Carlo ..... 224/258
5,816,461 A * 10/1998 Balcom ..... 224/269
5,890,478 A 4/1999 Dunmore
5,904,135 A * 5/1999 Summers et al. ..... 124/91
7,302,945 B2 * 12/2007 Ewing ..... 124/86
7,798,137 B2 * 9/2010 Ewing ..... 124/86

* cited by examiner

*Primary Examiner* — Justin Larson
*Assistant Examiner* — Lester L Vanterpool
(74) *Attorney, Agent, or Firm* — Ronald K. Aust; Aust IP Law

(57) ABSTRACT

An archery bow carrying apparatus includes a harness configured to be worn by an archer, the harness having a connection member. A loop member fixedly attaches to the bowstring of the bow at a location offset from the nock point. The connection member is configured to be removably engaged with the loop member. During the carrying of the archery bow, the loop member and the connection member bear at least a portion of the weight of the archery bow.

1 Claim, 7 Drawing Sheets

ARCHERY BOW CARRYING APPARATUS

CROSS REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to archery equipment, and, more particularly, to an archery bow carrying apparatus worn by an archer.

2. Description of the Related Art

During hunting and field archery events, an archer may find it necessary to carry a bow, such as a compound bow, for considerable distances. The weight of the bow may be increased if the bow includes a mounted arrow quiver that is loaded with arrows. To further increase the challenges faced by the archer, there is often the need to traverse difficult terrain, as well as the need to be ready to shoot in short order. As such, an archer may elect to hold the bow by the bow handle in one hand to be ready for use, which may be physically tiring due to the weight of the bow and the bow accessories. Also, at all times the bow is carried, only one hand is left free to assist in facilitating travel, e.g., to assist in climbing hills or moving underbrush out of the way. Thus, at times the archer may find that it would be particularly advantageous to have both hands free, e.g., to negotiate through the underbrush so as to proceed as quietly as possible.

Over a considerable period of time, several attempts have been made to provide a bow support worn by the archer to aid in carrying the bow.

In one such attempt, such as for example as disclosed in U.S. Pat. No. 5,246,154, a releasable hook/attachment cord arrangement is provided wherein the attachment cord may be looped around the bow handle or a portion of the limb of the bow. However, supporting a compound bow by the handle results in a natural rest state of the bow wherein the string is facing downwardly. Accordingly, either the bow must be rotated 180 degrees in order to bring the bow to a natural position for the archer to grasp the handle, or the bow is carried counter to its natural rest state and the string exerts pressure against the archer in attempting to rotate to the natural rest state.

In another such attempt, such as for example as disclosed in U.S. Pat. No. 5,038,987, a center-mount bowstring holder includes a shoulder/neck sling attached to a unitary member having two spaced hooks that directly engage the bowstring, with the arrow nock end positioned between the two hooks. By engaging the hooks with the bowstring, the bow may be carried in a more natural position. However, with this design the hooks have the potential to slide along the bowstring, which may result in dislodging the arrow nock from the bowstring, thereby causing the arrow to fall. Also, by directly engaging the bowstring with the two hooks, the two hooks may rub and wear the bowstring during normal use, which may lead to premature and unpredictable string failure that may result in damage to the bow and/or injury to the archer.

SUMMARY OF THE INVENTION

The present invention provides an archery bow carrying apparatus to aid an archer in carrying an archery bow effectively and safely.

The invention, in one exemplary embodiment, is directed to an archery bow carrying apparatus for carrying an archery bow having a bowstring, the bowstring having a nock point for receiving a nock of an arrow. The archery bow carrying apparatus includes a harness configured to be worn by an archer. The harness includes a connection member. A loop member fixedly attaches to the bowstring at a location offset from the nock point. The connection member is configured to be removably engaged with the loop member. During the carrying of the archery bow, the loop member and the connection member bear at least a portion of the weight of the archery bow.

An advantage of the archery bow carrying apparatus of the present invention is that the archery bow is held in the proper orientation such that the bow handle may be readily grasped by the archer.

Another advantage of the archery bow carrying apparatus of the present invention is that the connection member is prevented by the loop member from moving along the length of the bowstring, thus maintaining the archery bow in the desired orientation relative to horizontal and avoiding load shifting of the bow relative to the archer.

Another advantage of the archery bow carrying apparatus of the present invention is that the connection member does not contact the bowstring, thereby avoiding a potential source of premature wear of the bowstring that may result in failure of the bowstring while under tension.

BRIEF DESCRIPTION OF THE DRAWINGS

The above-mentioned and other features and advantages of this invention, and the manner of attaining them, will become more apparent and the invention will be better understood by reference to the following description of an embodiments of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
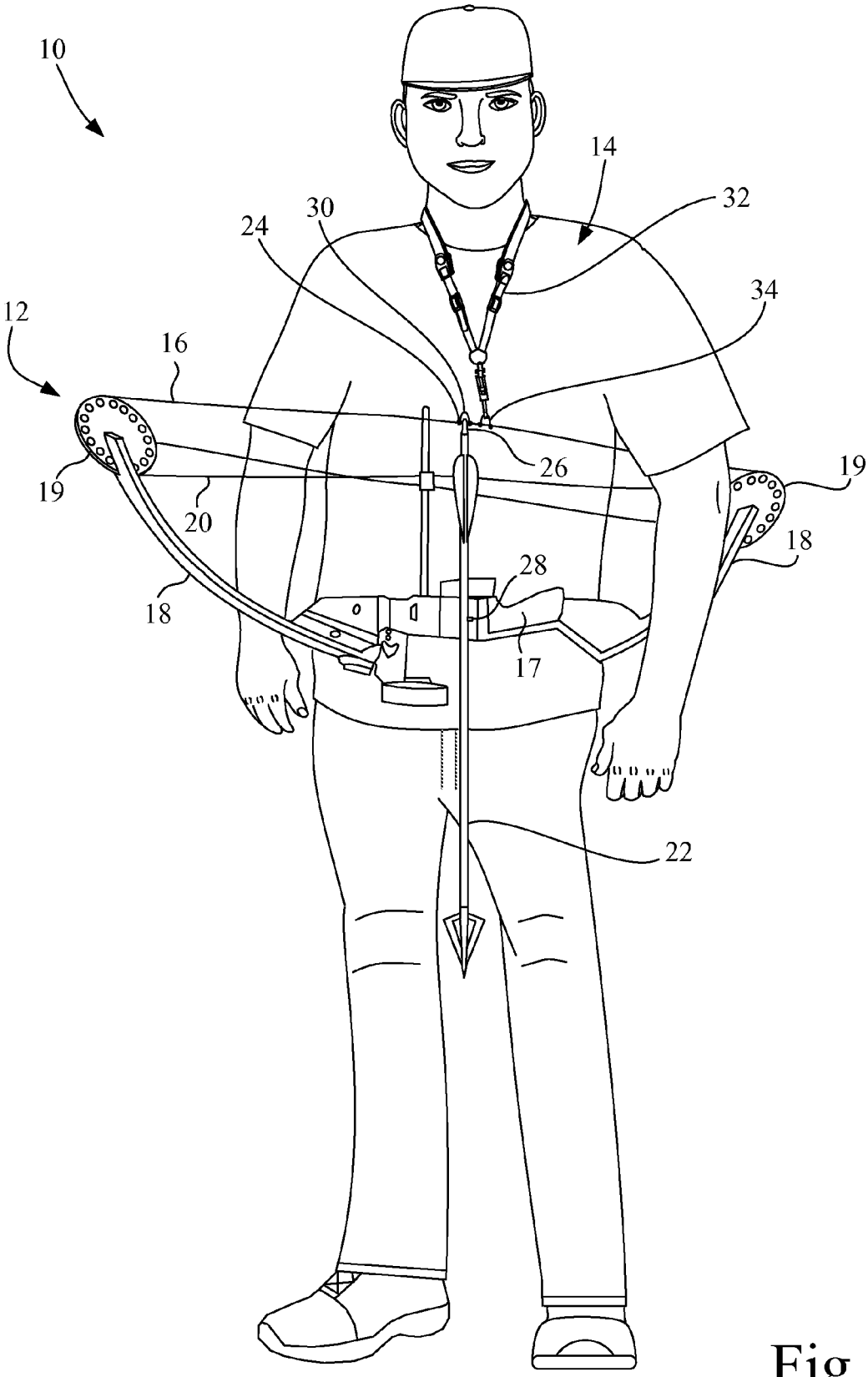
FIG. 1 is a depiction in front view of the archery bow carrying apparatus of the present invention being worn by an archer.

Referring now to the drawings and particularly to FIG. 1, there is shown an archery system 10 configured in accordance with an embodiment of the present invention. Archery system 10 includes an archery bow 12 and an archery bow carrying apparatus 14. For convenience and ease of discussion, thereinafter the archery bow sometimes may be referred to simply as "bow."

In the present embodiment shown, bow 12 may be a compound bow having a bowstring 16. Bow 12 further includes, as is typical with a compound bow, a handle 17, limbs 18, pulleys 19 and cables 20, with bowstring 16 being held in tension between the pulleys 19, and is configured to shoot an arrow 22. However, the present invention may also be adapted for use with other types of bows, such as a recurve bow or long bow.

Figure 2A:
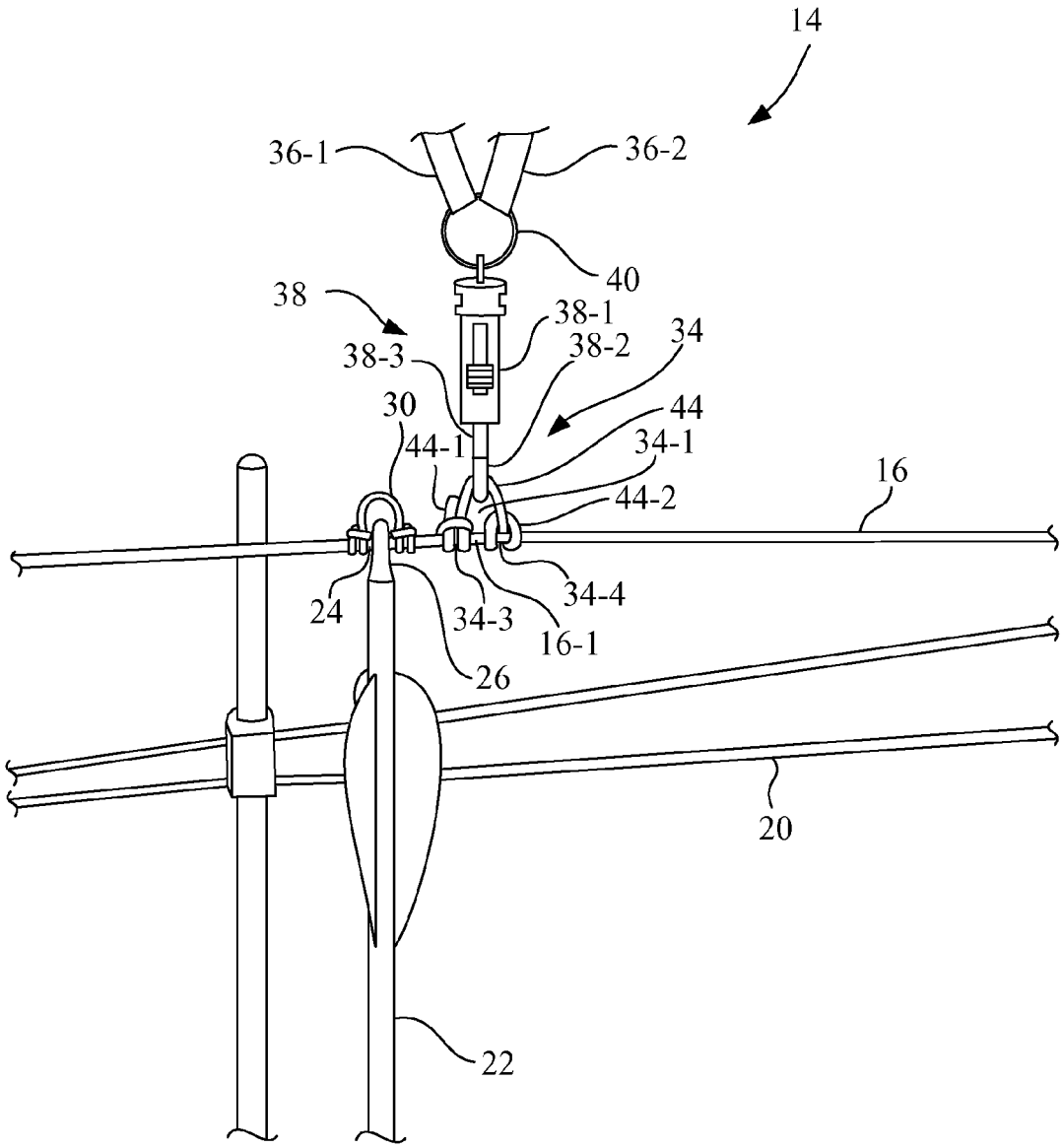
FIG. 2A shows a portion of the archery bow carrying apparatus of FIG. 1, with the connection member engaged with the loop member, and the closure member in the closed position.
Figure 2B:
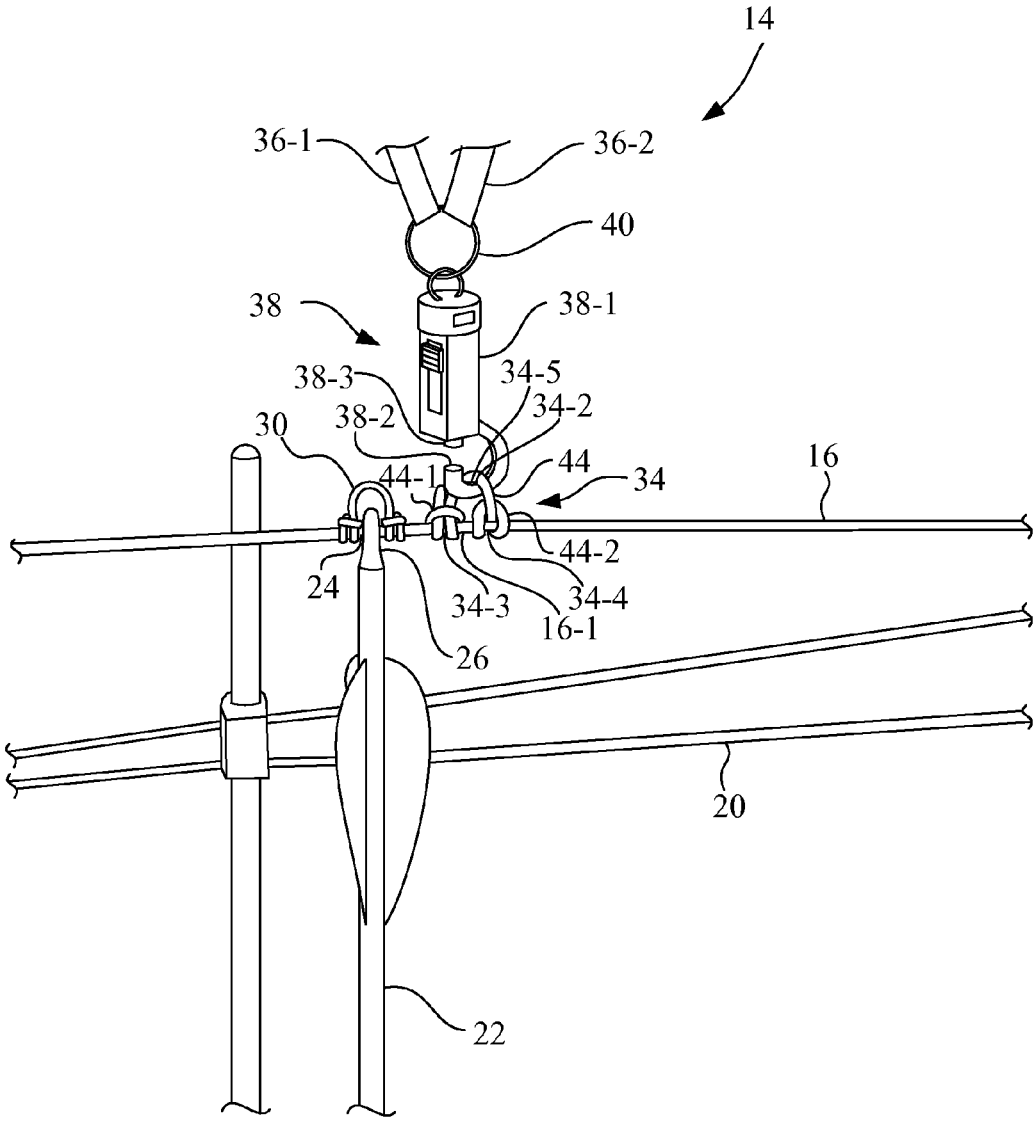
FIG. 2B shows a portion of the archery bow carrying apparatus of FIG. 1, with the connection member engaged with the loop member, and the closure member in the open position.
Figure 2C:
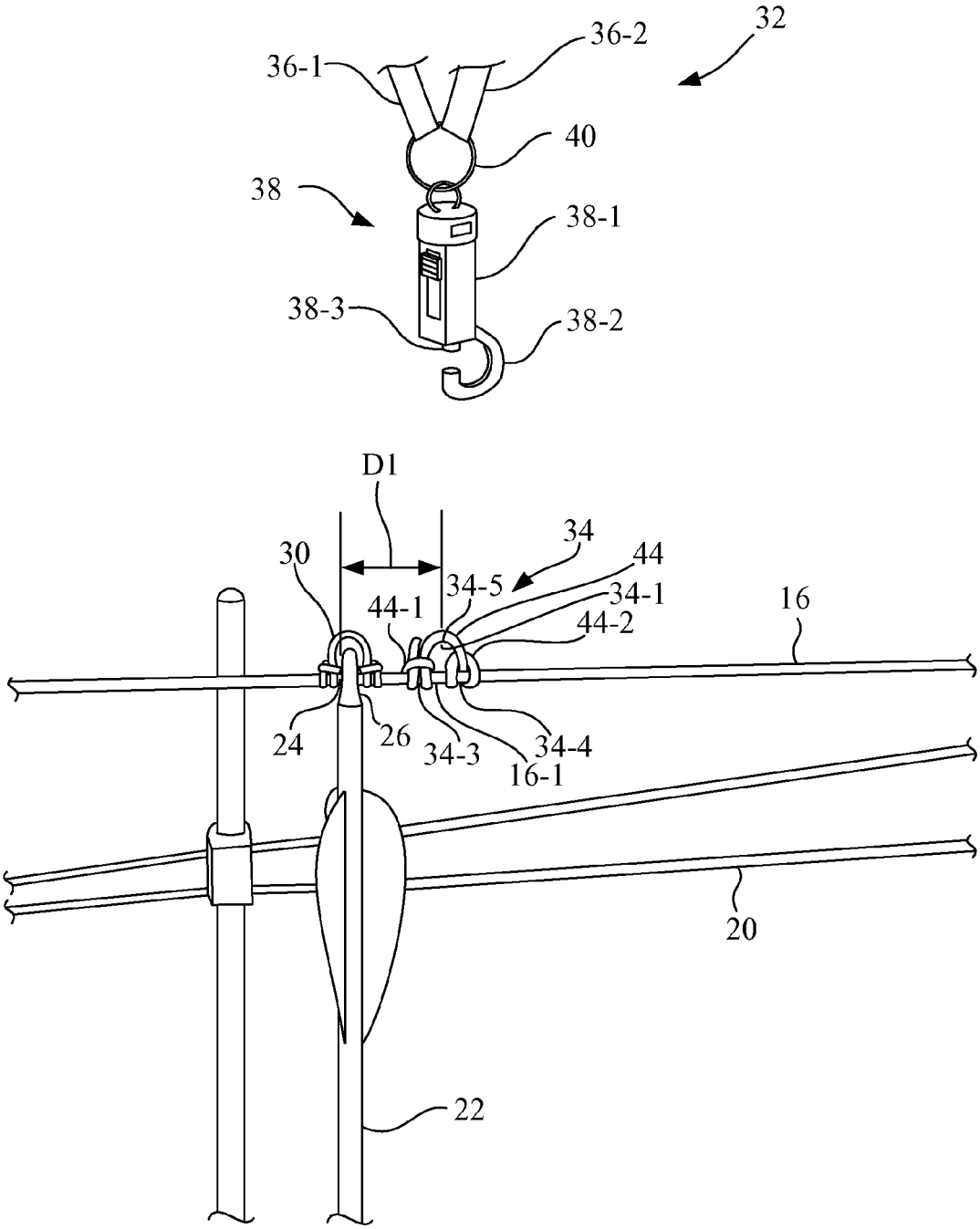
FIG. 2C shows a portion of the archery bow carrying apparatus of FIG. 1, with the connection member disengaged from the loop member.

Referring also to FIGS. 2A-2C, bowstring 16 has a nock point 24 that defines the location on bowstring 16 where a nock 26 of arrow 22 will be placed. Nock point 24 is typically determined using a T-square, as is known in the art, so as to define the location (i.e., nock point 24) on bowstring 16 where arrow 22 will be perpendicular to bowstring 16 when arrow 22 is on an arrow rest 28 of bow 12. Typically, nock point 24 will be at a location on bowstring 16 such that nock 26 of arrow 22 will be immediately below (immediately adjacent) nock point 24 when bow 12 is in its normal shooting orientation. As illustrated in FIGS. 1 and 2A-2C, in the present embodiment nock point 24 is marked by use of a mechanical release loop 30. Alternatively, nock point 24 may be marked in some other fashion, such as by a string knot or clip located on bowstring 16.

As more clearly shown in FIGS. 2A-2C, mechanical release loop 30 is located at nock point 24, with nock 26 of arrow 22 being located between the two ends of mechanical release loop 30. As such, mechanical release loop 30 is not offset from nock point 24, but rather marks nock point 24. The region of bowstring 16 that is engaged by nock 26 of arrow 22 is bounded by mechanical release loop 30 so as to position and retain arrow 22 at nock point 24. As is known in the art, mechanical release loop 30 provides an anchor point for the releasable attachment of a mechanical release aid for drawing and releasing bowstring 16.

In accordance with an embodiment of the present invention, archery bow carrying apparatus 14 includes a harness 32 (see also FIG. 3) configured to be worn by an archer and a loop member 34 fixedly attached to bowstring 16.

Figure 3:
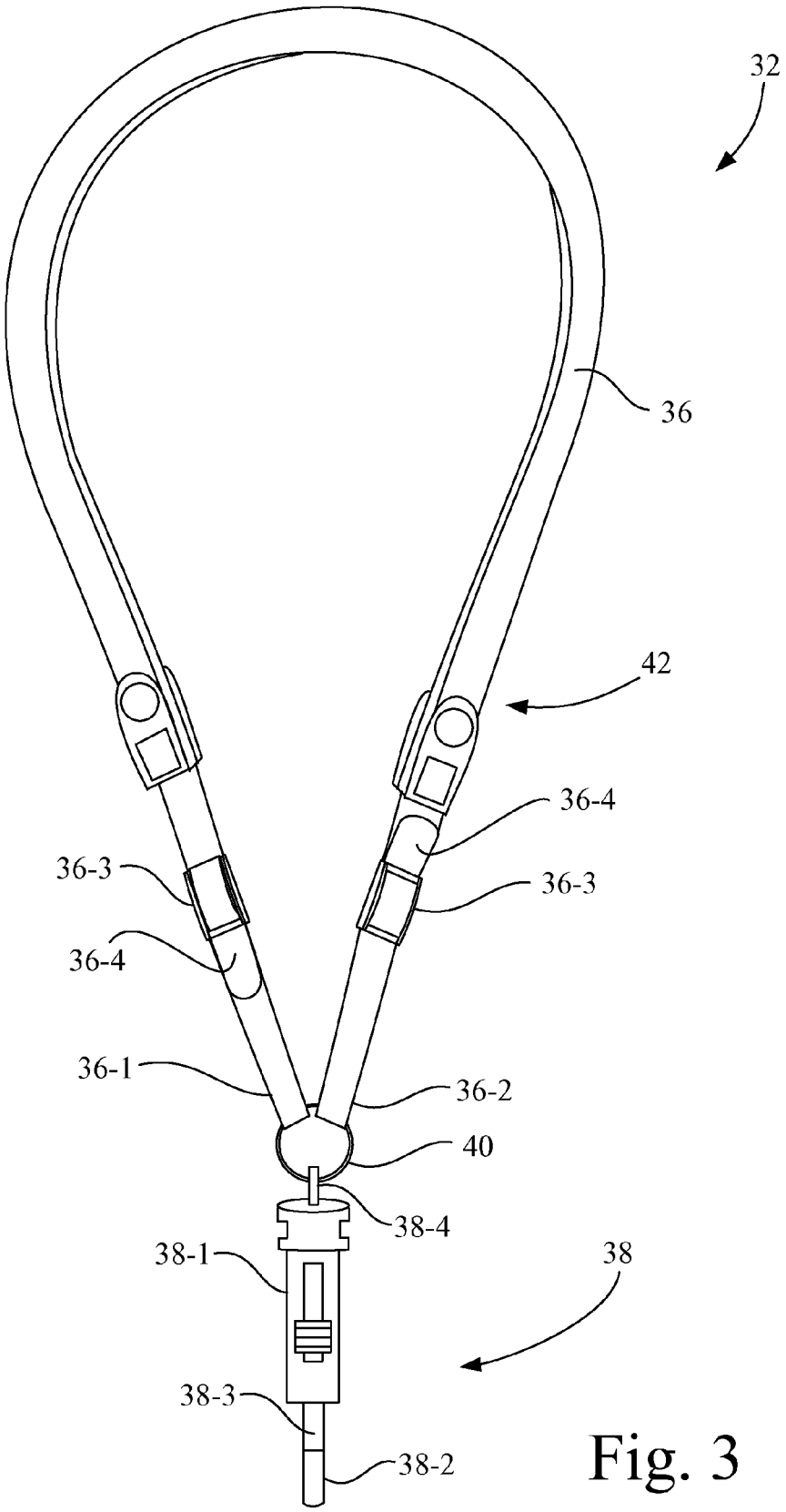
FIG. 3 shows the harness of the archery bow carrying apparatus of FIG. 1.

As shown in FIG. 3, harness 32 includes a strap 36 and a connection member 38. Strap 36 has a first end 36-1 and a second end 36-2. First end 36-1 and second end 36-2 are connected by a junction member 40 to form a neck loop 42. Junction member 40 may be, for example, a metal or plastic ring, a fabric member, or simply a sewn connection of first end 36-1 to second end 36-2. Connection member 38 is connected to junction member 40, such as by running junction member 40 through a connection eye 38-4 of connection member 38.

Strap 36 may be configured to be adjustable by a strap lengthening mechanism 36-3 (two shown) that is configured to take up or release a reserve portion 36-4 of adjustable strap 36. Strap lengthening mechanism 36-3 may be, for example, a slide type lengthening mechanism as shown, a hook-loop (e.g., Velcro® brand) arrangement, etc. It is contemplated, however, that other forms of strap 36 may be used, such as strap of fixed length. Strap 36 may have a width selected to spread out the pressure over a desired area over the archer's neck and shoulders, and may be for example a width of one to two inches, and may be varying in width at different portions of the strap.

Referring again also to FIGS. 1 and 2A-2C, connection member 38 is configured to be removably engaged, at the archer's discretion, with loop member 34. During the carrying of bow 12, loop member 34 and connection member 38 will bear at least a portion of the weight of bow 12, and may carry the entire weight of bow 12 and any accessories attached to bow 12 when bow 12 is freely suspended from connection member 38.

In one embodiment, for example, connection member 38 includes a shank portion 38-1, a hook portion 38-2 and a closure member 38-3. Hook portion 38-2 extends from shank portion 38-1 to form a J-shape. Closure member 38-3 is coupled to shank portion 38-1 and is configured to be selectively operable by the archer to open and close hook portion 38-2 to facilitate the selective attachment and detachment of connection member 38 to loop member 34. In the embodiment shown in FIGS. 1-2C, closure member 38-3 is in the form of a spring-loaded slide pin. The presence of closure member 38-3 helps to insure that connection member 38 will not be inadvertently detached from loop member 34 when carrying bow 12 through difficult terrain, i.e., closure member 38-3 is intentionally operated by the archer in order for connection member 38 to be detached from loop member 34.

Figure 4:
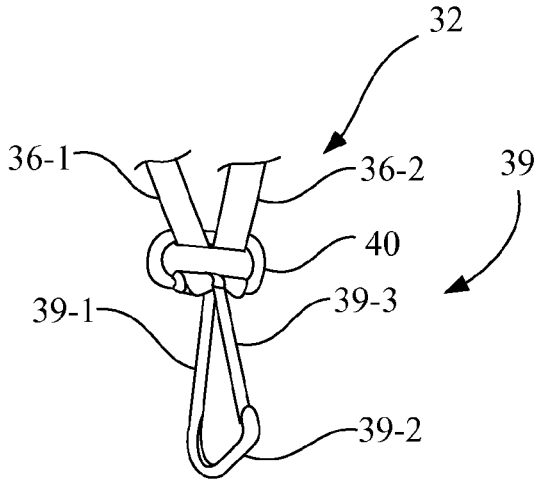
FIG. 4 shows an exemplary alternative configuration for the connection member of the harness of FIG. 3, disengaged from the loop member.
Figure 4:
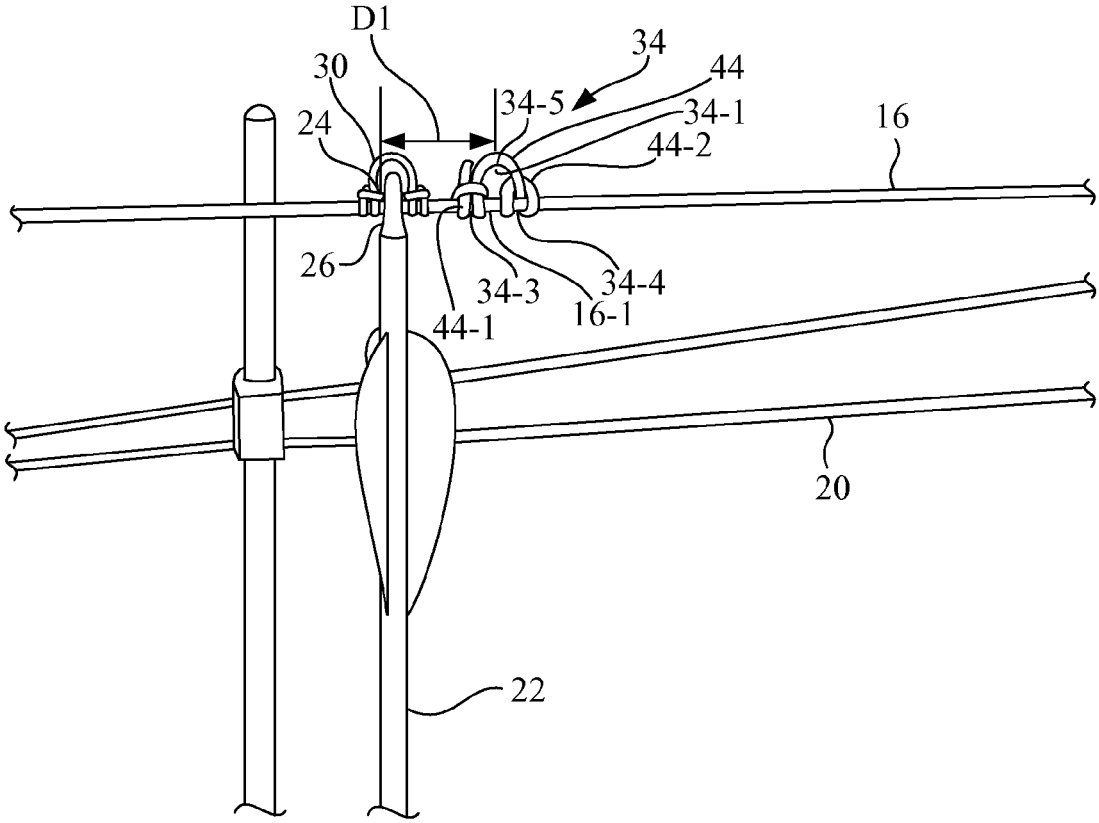

FIG. 4 shows an exemplary alternative configuration for connection member 38, identified as connection member 39. Connection member 39 includes a shank portion 39-1, a hook portion 39-2, and a closure member 39-3. Closure member 39-3 is in the form of a cantilever.

As a further alternative, although less preferred, it is contemplated that connection member 38 may forgo the closure member, thus leaving an open hook portion, e.g., hook portion 38-2.

Referring again to FIG. 2C, loop member 34 is fixedly attached to bowstring 16 at a location offset from nock point 24 by a distance D1. More specifically, distance D1 may be a distance measured to a midpoint of a center region 34-5 of loop member 34. Distance D1 may be, for example, a distance of 0.4 inches or greater. In turn, in the present embodiment having a mechanical release loop 30, loop member 34 is offset from mechanical release loop 30 and may be no closer to nock point 24 than is permitted by the physical space taken up by mechanical release loop 30.

As best shown in FIGS. 2A and 2C, loop member 34 defines an opening 34-1 that is sized to receive hook portion 38-2 of connection member 38 in a loose fit. Here, the term "loose fit" means that loop member 34 provides sufficient minimum clearance with hook portion 38-2 of connection member 38 (e.g., an area bounded by loop member 34 being oversized relative to a cross-section of hook portion 38-2 of connection member 38 by about ten percent). As best seen in FIG. 2B, when bearing the weight of bow 12, hook portion 38-2 of connection member 38 contacts a single continuous contact region 34-2 on loop member 34 without contacting bowstring 16.

In the embodiment shown, loop member 34 is attached to bowstring 16 at two spaced locations 34-3, 34-4, with a portion 16-1 of bowstring 16 extending between the two spaced locations 34-3, 34-4 such that opening 34-1 forms a D-shaped aperture when connection member 38 is disengaged from loop member 34 (see FIG. 2C). However, when bearing the weight of bow 12, opening 34-1 takes on more of a triangular shape (see FIG. 2A). A distance between the two spaced locations 34-3, 34-4 may be, for example, in a range of 0.25 to 0.75 inches, with the actual distance selection being determined at least in part based on a cross-section of hook portion 38-2 of connection member 38.

Loop member 34 may be formed, for example, from a length of an elongate cord 44 having opposing ends, and knots 44-1, 44-2 are formed at the opposing ends of cord 44 to fixedly attach cord 44 to bowstring 16 at the spaced locations 34-3, 34-4. Cord 44 may be made, for example, from nylon, cotton, metal or a combination thereof.

Figure 5A:
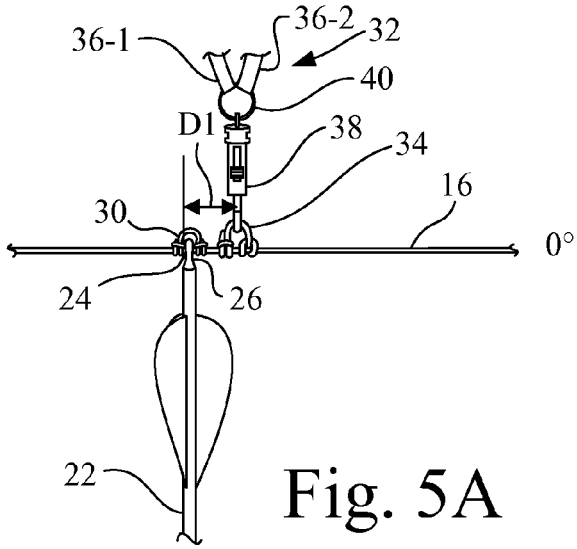
FIGS. 5A-5C illustrate how the location of attachment of loop member to the bowstring determines an amount of canting of the archery bow relative to horizontal.
Figure 5B:
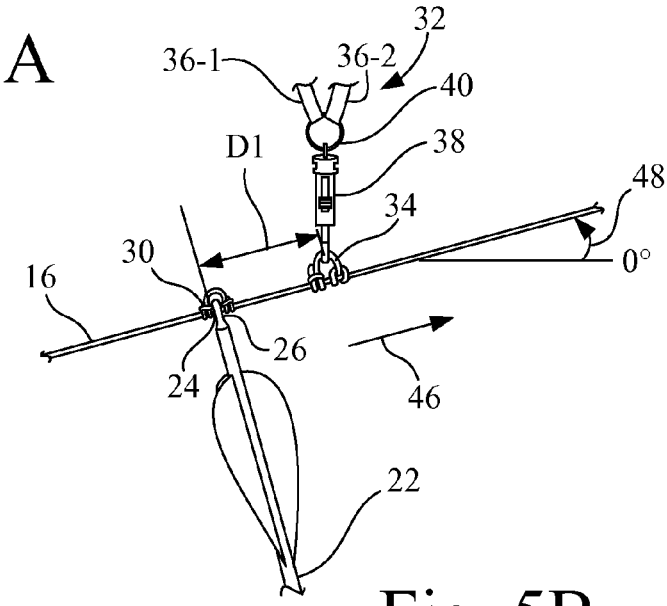
Figure 5C:
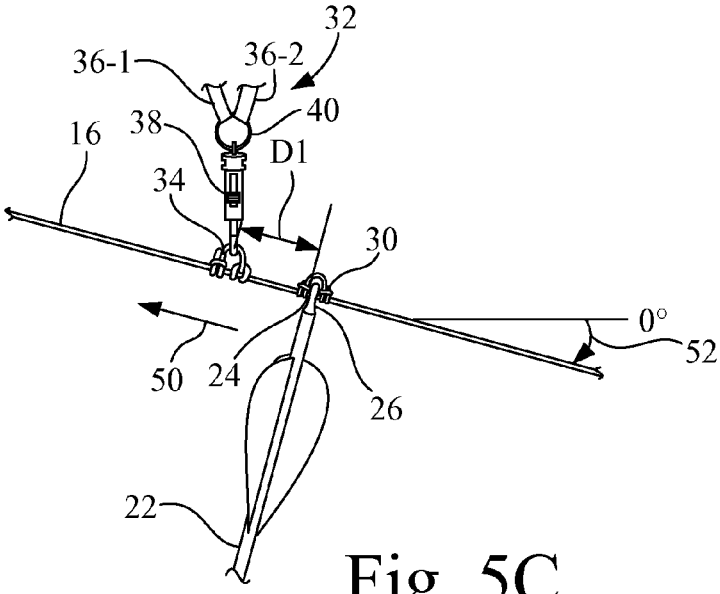

Referring also to FIGS. 5A-5C, the location of attachment of loop member 34 to bowstring 16 determines an amount of canting of bow 12 relative to horizontal (0 degrees). As illustrated in FIGS. 5B and 5C, the amount and direction of the canting of bow 12 may be selected to be in a range from horizontal to less than vertical (plus or minus). For example, by attaching loop member 34 to bowstring 16 offset closely, e.g., 0.5 inches, from nock point 24, as illustrated in FIG. 5A, bow 12 may be carried in a horizontal or near horizontal position. When the location of attachment of loop member 34 to bowstring 16 is selected for bow 12 to be carried in a substantially horizontal position, for example, connection member 38 contacts only central region 34-5 (see FIG. 2C) of loop member 34 when bearing the weight of bow 12.

Referring to FIG. 5B, by increasing the offset distance D1 between nock point 24 and loop member 34 in a direction 46 along bowstring 16 as shown, bow 12 will tend to cant (rotate) from horizontal by a positive angle 48 toward vertical (90 degrees) based on the center of mass of the combination of bow 12 and any bow-attached accessories. For example, when distance D1 is in a range of one to two inches, then angle 48 may be in a range of 10 to 20 degrees from horizontal. Increasing distance D1 to three inches, for example, may result in angle 48 being at an angle of 30 degrees.

Also, referring to FIG. 5C, by increasing the offset distance D1 between nock point 24 and loop member 34 in a direction 50 along bowstring 16 as shown, bow 12 will tend to cant (rotate) from horizontal by a negative angle 52 toward vertical (90 degrees) based on the center of mass of the combination of bow 12 and any bow-attached accessories. For example, when distance D1 is in a range of one to two inches, then angle 52 may be in a range of 10 to 20 degrees from horizontal. Increasing distance D1 to three inches, for example, may result in angle 52 being at an angle of 30 degrees.

As such, with the present invention each individual archer may determine a personal optimal angle of canting of bow 12 relative to horizontal so as facilitate the carrying of bow 12 in the proper orientation to be readily grasped. Also, the present invention avoids direct contact of the load bearing connection member 38 of harness 32 with bowstring 16, thereby eliminating a potential source of premature wear on bowstring 16. Further, the present invention prohibits any movement of bow 12 relative to harness 32 along the length of bowstring 16, thus avoiding load shifting of bow 12 relative to the archer.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An archery bow carrying apparatus for carrying an archery bow having a bowstring, said bowstring having a nock point for receiving a nock of an arrow, and having a first loop member having a first pair of ends fixedly attached to said bowstring at a location such that the first loop is centered on said nock point, said first loop member being configured to provide an anchor point for releasable attachment of a mechanical release aid for drawing and releasing said bowstring, said archery bow carrying apparatus comprising:

a harness configured to be worn by an archer, said harness including a strap and a connection member connected to said strap, said connection member having a hook portion; and a second loop member having a second pair of ends that fixedly attaches to said bowstring at a location such that the second pair of ends is entirely offset to one side of the first pair of ends of said first loop member along said bowstring, said hook portion of said connection member of said harness being configured to be removably engaged with said second loop member, and configured such that during said carrying said second loop member and said connection member together bear at least a portion of the weight of said archery bow through said bowstring.

* * * * *